United States Patent [19]

Dye et al.

[11] 3,968,910

[45] July 13, 1976

[54] SHOULDER PACK CHILD CARRIER

[75] Inventors: John Dye; Paal Myklebust, both of Reedsburg, Wis.

[73] Assignee: Gerber Products Company, Fremont, Mich.

[22] Filed: July 11, 1974

[21] Appl. No.: 487,694

[52] U.S. Cl. ..... 224/6; 224/25 A
[51] Int. Cl.[2] ..... A45F 3/26
[58] Field of Search ..... 224/6, 25 A, 42.46 R, 224/5 R, 8 R, 8 A

[56] References Cited

UNITED STATES PATENTS

| | | | |
|---|---|---|---|
| 2,455,119 | 11/1948 | Hall | 224/42.46 R X |
| 3,421,670 | 1/1969 | Hansson | 224/6 |
| 3,610,489 | 10/1971 | Parsons | 224/6 |
| 3,733,017 | 5/1973 | Pletz | 224/25 A |

*Primary Examiner*—Robert J. Spar
*Assistant Examiner*—Jerold M. Forsberg
*Attorney, Agent, or Firm*—Townsend and Townsend

[57] ABSTRACT

An improved carrier for supporting a child on the shoulders of the wearer, such as an adult. The carrier comprises a frame having a pair of identical side members interconnected by a pair of vertically spaced crosspieces. Each side member has an upper part formed of a front segment and an inclined back segment. A backrest of flexible material, such as canvas, spans the distance between the back segments and is coupled at its lower margin to the upper crosspiece. A pair of straps coupled to the backrest and to the lower portions of the side members form loops for receiving the arms of the wearer. A child disposed on the carrier has a generally horizontal seat formed by the forward, lower margin of the backrest and the crosspiece in cooperation with the shoulders of the wearer. The front segments of the upper parts of the side members present side rails which confine the child on the seat.

9 Claims, 3 Drawing Figures

SHOULDER PACK CHILD CARRIER

This invention relates to improvements in the use of baby carriages of the type worn on the back of an individual and, more particularly, to a carrier for supporting a child near the shoulders of an individual.

BACKGROUND OF THE INVENTION

Baby carriers adapted to be worn on the back of an individual, such as an adult, have been commercially available for a number of years. For the most part, these carriers are made so that an infant or child is carried in the vicinity of the middle of the back. When a child is carried in this way, its legs either abut or straddle the back of the individual. This construction causes considerable strain on the back of the individual and requires that the carrier be in the shape of a pocket or pouch to properly support the child.

Other attempts have been made to provide baby carriers in which the child is disposed near the shoulders of the adult so that the legs of the child partially embrace the neck of the adult. In this way, the adult can hold onto the legs to provide the infant with a greater sense of security against falling. Typical of these latter attempts are those disclosed in U.S. Pat. Nos. 3,610,489 and 3,698,608.

In U.S. Pat. No. 3,610,489, a flexible, canvas pouch or pocket with leg holes is removably mounted by suitable braces to a backpack frame of the type having upright, tubular side frame members. The pouch projects laterally a considerable distance of the back of the wearer so that the weight of the child carried in the pouch causes considerable strain on the back. The child does not sit sufficiently forwardly to allow its weight to be near the vertical plane of the major portion of the wearer's back.

In U.S. Pat. No. 3,698,608, a child is completely unsupported above its waist and its hands must encircle the head of the adult for support. Moreover, the seat for the child rests, by virtue of a complicated construction, on the shoulders of the adult and the seat itself is of a moldable material, such as plastic or the like. These features minimize its versatility and its adaptability for children of different sizes.

SUMMARY OF THE INVENTION

The present invention is directed to an improved carrier for a child, such as a baby or infant, wherein the carrier is made so that it cooperates with the shoulders of the wearer to form a generally horizontal seat for the child which allows the latter to be seated sufficiently forwardly and close to the vertical plane of the back of the wearer yet the child is completely safe at all times and prevented from falling out of the carrier. Moreover, the carrier of this invention can be worn in a comfortable manner for relatively long periods of time and can be quickly and easily placed on and taken off the back of an individual, such as an adult. The carrier is also formed of a relatively few parts, is lightweight in construction, and can be quickly and easily assembled.

The carrier of this invention includes a pair of side members interconnected at two vertically spaced locations by crosspieces which span the distance therebetween. The lower crosspiece and the side members can be formed from a single length of tubular, lightweight material, such as aluminum or the like, to minimize production costs. A flexible backrest of a suitable material, such as canvas or the like, is provided for the upper parts of the side members, the backrest spanning the distance between inclined segments of such upper parts and having a lower margin connected to the upper crosspiece. Thus, such lower margin of the backrest and the upper crosspiece form a generally horizontal seat for a child when the carrier is worn on the back of an individual. This seat cooperates with the shoulders of the wearer to comfortably support the child yet the side members have forwardly extending segments which provide side rails which confine the child on the seat. In such a position, the legs of the child extend forwardly and along the sides of the neck of the adult.

The carrier can accommodate and safely support an infant or a child older than an infant, such as a preschool child. Also, the carrier is constructed to allow the arms and hands of the wearer to be free for carrying other bundles or articles, since the legs of the child need not be grasped by the wearer when the child is carried in the carrier.

The primary object of this invention is to provide an improved back carrier for a child wherein the carrier has means defining a generally horizontal seat near the shoulders of the wearer and sufficiently close to the vertical plane of the major portion of the wearer's back to minimize strain on the back while assuring complete safety of the child disposed in the carrier.

Another object of this invention is to provide an improved shoulder pack child carrier of the type described wherein the carrier includes a pair of side members having upwardly and rearwardly inclined segments to which the sides of a flexible backrest are coupled and a crosspiece to which the lower margin of the backrest is coupled so that the lower margin of the backrest and the crosspiece cooperate with the shoulders of the wearer to form a generally horizontal seat for safely supporting a child disposed between the side members.

A further object of this invention is to provide a carrier of the aforesaid type wherein the carrier is simple and rugged in construction, can be easily assembled and has a relatively few number of parts to minimize production costs.

Other objects of this invention will become apparent as the following specification progresses, reference being had to the accompanying drawing for an illustration of the invention.

Figure 1:
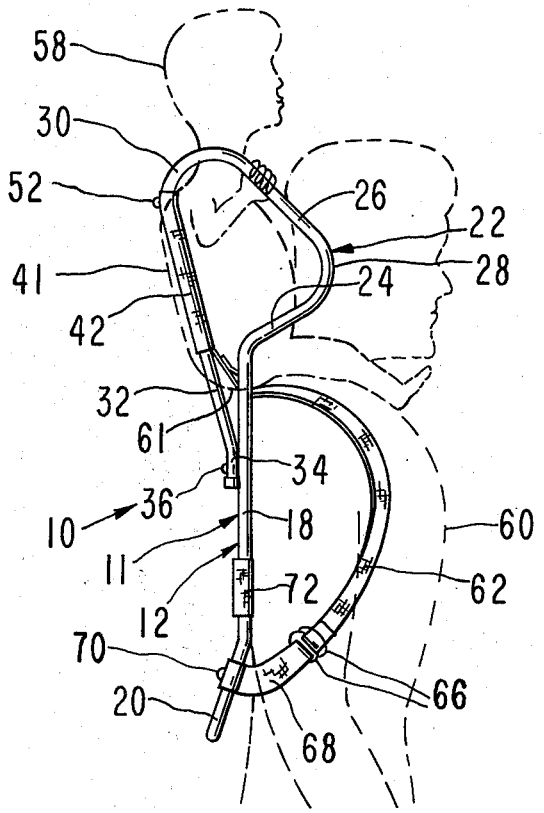
FIG. 1 is a side elevational view of the carrier of this invention showing the way in which it is worn for supporting a child.
Figure 2:
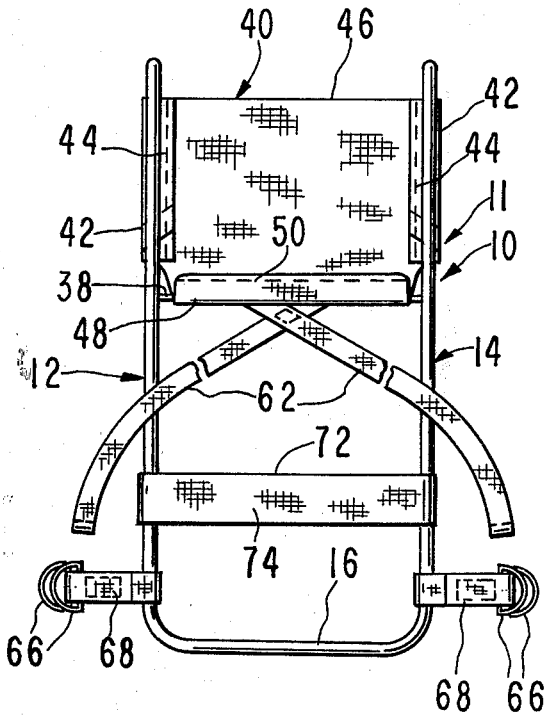
FIG. 2 is a front elevational view of the carrier.
Figure 3:
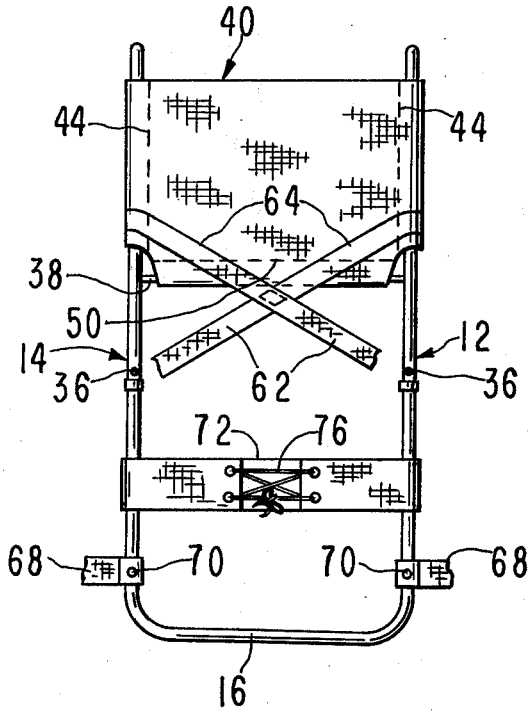
FIG. 3 is a rear elevational view thereof.

The shoulder pack child carrier of this invention is broadly denoted by the numeral 10 and includes a frame 11 having a pair of side members 12 and 14 which are substantially identical with each other. The frame further includes a generally straight crosspiece 16 which interconnects the lower ends of members 12 and 14. Preferably, members 12 and 14 and crosspiece 16 are integral with each other so that they can be formed from a single length of generally rigid material. Typically, the material can be of a tubular metallic stock, such as aluminum or the like, to minimize its weight yet allow it to be readily shaped and to be somewhat resilient to facilitate assembly of another part or parts thereto.

Each of members 12 and 14 includes a central, straight part 18, a lower, straight part 20 which makes an angle with and extends downwardly and rearwardly from part 18, and an upper, irregularly shaped part 22 comprised of several segments. The three parts 18, 20 and 22 are coplanar and integral with each other.

Upper part 22 includes a pair of straight segments 24 and 26 interconnected by a curved segment 28. Segment 24 is connected to and makes an angle with part 18 and extends upwardly and forwardly therefrom. Segment 26 extends upwardly and rearwardly from the upper end of curved segment 28. Part 22 further includes a second curved segment 30 integral with the upper end of segment 26, and a straight segment 32 extending downwardly and forwardly from the lower end of curved segment 30. Segment 32 has an angular foot portion 34 secured by a pin 36 to part 18.

Parts 18 of members 12 and 14 are interconnected near their upper extremities by a second, generally straight crosspiece 38 which can be in any suitable form, such as a tubular rod of the same material as members 12 and 14. Preferably, parts 18 have respective holes which face each other and which receive the ends of crosspiece 38. The inherent resilience of the junctions between members 12 and 14 and crosspiece 16 retains crosspiece 38 within the holes, yet members 12 and 14 can be separated sufficiently to permit quick assembly of crosspiece 38 in the holes.

A backrest 40 is coupled to and spans the distance between segments 32 of members 12 and 14. Backrest 40 is of a flexible, generally inelastic material, such as canvas or the like. It has a pair of sides margins 42 which are doubled back upon themselves and stitched along a line 44 so as to form tubular portions which receive segments 32. The upper margin 46 of backrest 40 is adjacent to the junction between segments 32 and respective curved segments 30 thereabove.

Backrest 40 further has a lower margin 48 which is doubled back upon itself and stitched along a line 50 to form a tubular portion for receiving crosspiece 38. Thus, backrest 40 is coupled to members 12 and 14 at three, longitudinally extending zones, namely, along segments 32 and along crosspiece 38. In this way, the backrest is fully supported at three of its four margins to provide a suitable backing support for a child 58 disposed on the shoulders of an adult 60 when carrier 10 is worn on the back of the adult.

To mount carrier 10 on the back of adult 60, a pair of straps 62 are provided, straps 62 having upper end portions 64 which are stitched in any suitable manner to backrest 40. Moreover, for safety purposes, the upper ends of portions 64 are stitched to side margins 42 and partially wrapped around the same so that the force exerted on straps 62, when carrier 10 is worn by adult 60, is more uniformly distributed between backrest 40 and segments 32.

The lower end of each strap 62 is adapted to be removably coupled with a pair of rings 66 carried by a short strap segment 68 secured in any suitable manner to the corresponding lower part 20. A pin 70 secures each strap segment 68 to the corresponding part 20 to prevent movement therebetween.

A strap 72 is carried by parts 18 of members 12 and 14 near the lower ends thereof for engaging the back of adult 60 when carrier 10 is worn. To this end, strap 72 has a front face 74 which is generally flat and flexible to conform to the portion of the back which strap 72 contacts. The ends of strap 72 are coupled together in any suitable manner, such as by lacing 76 so that the strap can be adjustably tightened. Also, the ends of strap 72 can be moved up and down along parts 18 to accommodate it to the back of adult 60.

In use, carrier 10 is mounted on the back of adult 60 after the lower ends of straps 62 are coupled with respective rings 66 and after the adult places his arms through the loops formed by members 12 and 14 and straps 62. The straps can be tightened so as to bring parts 18 of members 12 and 14 into substantially vertical positions (FIG. 1) which are their normal positions on the adult's back. When carrier 10 is properly located, backrest 40 extends upwardly and slightly rearwardly from crosspiece 38. Thus, the lower margin of backrest 40 and the portion of the shoulders of adult 60 immediately forwardly of crosspiece 38 presents a generally horizontal seat 61 for child 58. The material of backrest 40 can be such as to permit a slightly amount of yielding when supporting the child. This feature will, therefore, assure that seat 61 will have a substantially horizontal orientation. Also, the lower margin 50 of backrest 40 extends forwardly out of the generally inclined plane of the major portion of backrest 40 to enhance the horizontal character of the seat when the child is disposed thereon. The dashed line 41 of FIG. 1 shows the general shape of backrest 40 and its lower margin when the child is in seat 61. This shape is due to the material of backrest 40 and the inherent resilience in the various parts of frame 11.

When the child is on the seat, its legs extend forwardly and partially about the neck of adult 60. In this position, the child is adequately protected since he cannot fall backwardly due to backrest 40 and cannot fall to the side because of upper parts 22 of members 12 and 14. Moreover, the segments 26 provide rails which can be grasped by the child for support as the adult walks in a forward direction.

Carrier 10 fits comfortably on the back of the adult since strap 72 can be adjusted so that it engages the back at a desired location. In this way, crosspiece 16 remains out of contact with the back yet the crosspiece continues to provide structural rigidity to frame 11. Since the weight of the child is partially carried by the shoulders, the center of mass of the child is sufficiently forwardly to minimize any strain on the back of the adult due to spacing such center of mass outwardly from the back as would occur with the structure of U.S. Pat. No. 3,610,608 mentioned above. Also, the relatively few parts of carrier 10 renders it extremely simple in construction yet it has sufficient structural strength and provides a safe, reliable carrier for a child. The construction further allows the adult's hands and arms to be free to carry other bundles or articles since the adult need not grasp the legs of the child when the latter is being carried by carrier 10.

We claim:

1. A child carrier adapted to be worn on the back of an individual comprising:

a frame having a pair of spaced, generally rigid, generally parallel side members, each side member having an upper part, a central part, a junction between said central and upper part, and a lower part, a first crosspiece interconnecting the lower parts of said side members, and a second crosspiece spanning the distance between and carried by the side members near the junctions of the central and upper parts thereof, the second crosspiece being operable to limit the movement of the upper parts of the side members toward each other, each upper part having a first segment extending upwardly and rearwardly of the wearer and a second segment extending downwardly from said first segment to such central part; a flexible backrest having a pair of spaced, tubular side margins and a tubular lower end margin formed integrally therewith, each said first segment extending through the respective side margins and the second crosspiece extending through the lower end margin, and strap means coupled with said side members for removably mounting the frame on the back of an individual, such that when the child carrier is mounted to the back of the individual with the side members substantially vertical and each upper part extending relatively above the shoulders of said individual the backrest forms a child-receiving space with the shoulders and head of the individual that causes the weight of the child to bear downwardly upon the shoulders of said individual.

2. A carrier as set forth in claim 1, wherein each upper part has a second segment secured to its inclined segment thereof, and extending forwardly and downwardly therefrom, the second segments defining a pair of side rails for a child disposed in said space.

3. A child carrier as set forth in claim 1, wherein the upper, central and lower parts of each side member are generally coplanar with each other.

4. A child carrier as set forth in claim 1, wherein each tubular side portion has means for securing the same to the corresponding segment.

5. A child carrier as set forth in claim 1, wherein is included a strap adjustably carried by and spanning the distance between the central parts of said side members at a location between said crosspieces, said strap adapted to engage the back of an individual when the frame is mounted thereon.

6. A child carrier as set forth in claim 1, wherein said side members and the first crosspiece are formed from a single length of generally rigid material capable of being shaped to present the upper, central and lower parts of the side members.

7. A child carrier as set forth in claim 6, wherein each central part has a hole therein, the holes in the central parts being in facing relationship to each other, said second crosspiece having its opposed ends removably received within respective holes, the frame having a resilience capable of permitting the central parts to be urged away from each other by an amount sufficient to allow the ends of the second crosspiece to be inserted in said holes.

8. A carrier as set forth in claim 5, wherein the strap is adjustable along the lengths of said side members.

9. A child carrier adapted to be worn on the back of an individual comprising: a frame having a pair of spaced, generally rigid, generally parallel side members, each side member having an upper part, a central part, a junction between said central and upper part, and a lower part, a first crosspiece interconnecting the lower part of said side members, and a second crosspiece spanning the distance between and carried by the side members near the junctions of the central and upper parts thereof, the second crosspiece being operable to limit the movement of the upper parts of the side members toward each other, said side members and the first crosspiece being formed from a single length of generally rigid material capable of being shaped to present the upper, central and lower parts of the side members, each upper part having a first segment extending upwardly and rearwardly of the wearer and a second segment extending downwardly from said first segment to such central part; a flexible backrest having a pair of spaced, tubular side margins and a tubular lower end margin formed integrally therewith, each said first segment extending through respective side margins and the second crosspiece extending through the lower end margin, and strap means coupled with said side members for removably mounting the frame on the back of an individual so that a child-receiving space is formed with the shoulders and head of the individual that positions the child carried therein generally upon the shoulders of the individual when the frame is worn on the back of said individual.

* * * * *